US006299568B1

(12) United States Patent
Prok

(10) Patent No.: US 6,299,568 B1
(45) Date of Patent: Oct. 9, 2001

(54) MODULAR EXERCISE EQUIPMENT

(76) Inventor: Gerard L. Prok, 41 Schuyler Dr., Edison, NJ (US) 08817

( * ) Notice: Subject to any disclaimer, the term of this patent is extended or adjusted under 35 U.S.C. 154(b) by 0 days.

(21) Appl. No.: 09/112,678

(22) Filed: Jul. 9, 1998

(51) Int. Cl.[7] ..... A63B 21/06
(52) U.S. Cl. ..... 482/104; 482/98; 482/93
(58) Field of Search ..... 482/104, 98, 93–103, 482/23, 142, 101, 97

(56) References Cited

U.S. PATENT DOCUMENTS

| | | |
|---|---|---|
| 4,188,029 | 2/1980 | Brower et al. . |
| 4,316,609 | 2/1982 | Silberman . |
| 4,382,596 | 5/1983 | Silberman . |
| 4,441,706 | 4/1984 | Kozaniewski . |
| 4,561,651 | 12/1985 | Hole . |
| 4,564,194 | 1/1986 | Dawson . |
| 4,729,561 | 3/1988 | Desjardins . |
| 4,744,560 | 5/1988 | Azari . |
| 5,082,260 | 1/1992 | Dinelli . |
| 5,328,428 | 7/1994 | Huang . |

FOREIGN PATENT DOCUMENTS

4307632A1 9/1993 (DE) ..... A63B/21/06

OTHER PUBLICATIONS

Catalogs: Dax Safety Gym Systems, Aug. 1988, Phoenix, AZ, Parabody Strength Building Gear, 1995; Yukon Fitness Equipment, 1994–1995 Previous device by Pro–Active Fitness Systems, Inc. which is owned by applicant. It appears to be prior art.

*Primary Examiner*—Jerome Donnelly
(74) *Attorney, Agent, or Firm*—Walter J. Tencza, Jr.

(57) ABSTRACT

An modular apparatus comprised of a cage and various components for attaching to the cage for use as exercise equipment is provided. A top member of the cage is connected to a first adjustable member having a first pulley. The first adjustable member may be adjustably fixed to the cage through an intermediate member hollow tube connected to the top member of the cage. The first adjustable member can be part of an overall pulley device which is also attached to the cage. The pulley device is preferably comprised of overlapping upper and lower pulley devices. The overall pulley device may be comprised of a top member having second and third pulleys mounted thereon, a bottom member having a fourth pulley rotatably mounted thereto, and a floating member having fifth and sixth pulleys rotatably mounted thereto. A first cord and a second cord can be provided for the upper and lower pulley devices. A second adjustable member for providing an adjustable foot brace is disclosed. The second adjustable member may be an elongated tube which can be slid in and out of the bottom member of the cage. The second adjustable member may have two pulleys rotatably mounted to it at each end. An adjustable seating device, having flanges, can be connected to a side member of the cage. A "Smith" machine type device can be attached in a modular manner to the cage. Right and left carriages comprised of first and second rollers opposing rollers can be used.

1 Claim, 16 Drawing Sheets

MODULAR EXERCISE EQUIPMENT

FIELD OF THE INVENTION

This invention relates to improved methods and apparatus for providing exercise equipment.

BACKGROUND OF THE INVENTION

There is a need for better exercise equipment particularly heavy duty exercise equipment.

SUMMARY OF THE INVENTION

The present invention in some embodiments provides an apparatus comprised of a cage and various components for attaching to the cage for use as exercise equipment. One or more components can be attached to the cage in a modular fashion.

In one embodiment a top member of the cage is connected to a first adjustable member having a first pulley. The first adjustable member may be adjustably fixed to the cage through an intermediate member connected to the top member of the cage. Preferably, the intermediate member is a hollow tube and the first adjustable member fits into the hollow tube and can be slid in and out to adjust the location of the first adjustable member at a plurality of locations. Preferably holes on the first adjustable member line up with holes on the intermediate member. The first adjustable member can be comprised of first and second elongated member portions, the first portion inserted into the intermediate member and the second portion having the first pulley rotatably mounted thereon.

In one embodiment the first adjustable member can be part of an overall pulley device which is also attached to the cage. The pulley device is preferably comprised of overlapping upper and lower pulley devices. The overall pulley device may be comprised of a top member having second and third pulleys mounted thereon, a bottom member having a fourth pulley rotatably mounted thereto, and a floating member having fifth and sixth pulleys rotatably mounted thereto. A first cord can be provided for the upper pulley device and a second cord can be provided for the lower pulley device.

In one embodiment a second adjustable member is provided which can be connected to a bottom member of the cage. The second adjustable member may have adjustably attached to it an adjustable foot brace. The second adjustable member may be an elongated tube which can be slid in and out of the bottom member of the cage. The second adjustable member may have two pulleys rotatably mounted to it at each end for use with the second cord of the lower pulley device.

In another embodiment an adjustable seating device can be connected to a side member of the cage. The adjustable seating device is comprised of a third adjustable member having a top to which a seat is attached and a front to which first and second flanges are attached. The first and second flanges have a gap between them which is greater than the width of the side member of the cage. The first and second flanges are connected by a first fastener so that the side member lies between the front of the adjustable member and the first fastener. The third adjustable member has a bottom to which a support member is attached and the support member is connected to the side member of the cage by a second fastener.

In another embodiment a weight lifting device, of a type known as a "Smith" machine, can be attached in a modular manner to the cage. The weight lifting device is comprised of two mirror sides: a right side and a left side. The right side has a right side member and a right rail. The right side has a first right bottom member and a second right bottom member, where said members are substantially perpendicular to one another and a right bottom flat member. The right side has similar corresponding top members. The right bottom flat member is connected to the right side member of the cage so that the right bottom flat member is parallel to and adjacent the right member of the cage, and the right bottom flat member does not extend in length beyond the dimensions of the cage. The left side of the weight lifting device is a substantial mirror image of the right side.

The weight lifting device described above may be further comprised of mirror right and left carriages riding on mirror right and left rails. Each carriage is comprised of first and second rollers, said first and second rollers opposing one another, wherein the corresponding rail lies between the appropriate first and second roller, each carriage able to move up and down on its respective rail and as it moves the two opposing rollers rotate.

DETAILED DESCRIPTION OF THE DRAWINGS

Figure 1:
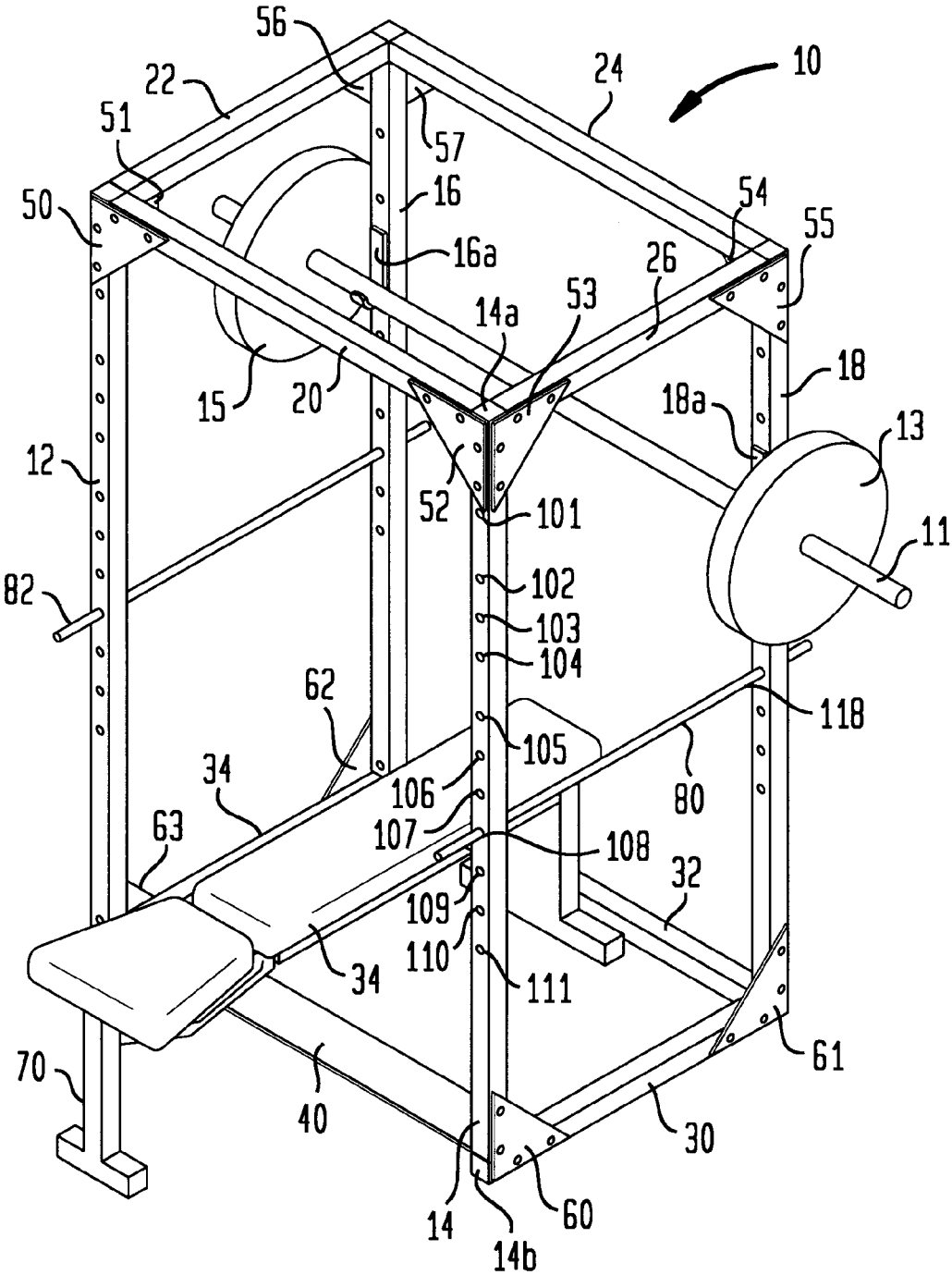
FIG. 1 shows a perspective view of a cage for use in accordance with an embodiment of the present invention.

FIG. 1 shows a perspective view of a cage 10 for use in accordance with an embodiment of the present invention. The cage 10 is comprised of side members 12, 14, 16, and 18, bottom members 30, 32, 34, and 40, and top members 20, 22, 24, and 26.

Each of the side members 12, 14, 16, and 18 is fixed to two of the bottom members and two of the top members. Each of the side members has a top end and a bottom end, for example side member 14 has a top end 14*a* and a bottom end 14*b*. The side member 14 is connected at its top end 14*a* to top members 20 and 26. The side member 14 is connected at its bottom end 14*b* to bottom members 30 and 40. The side member 14 is connected to top members 20 and 26 by gusset plates 52 and 53 respectively.

Figure 5:
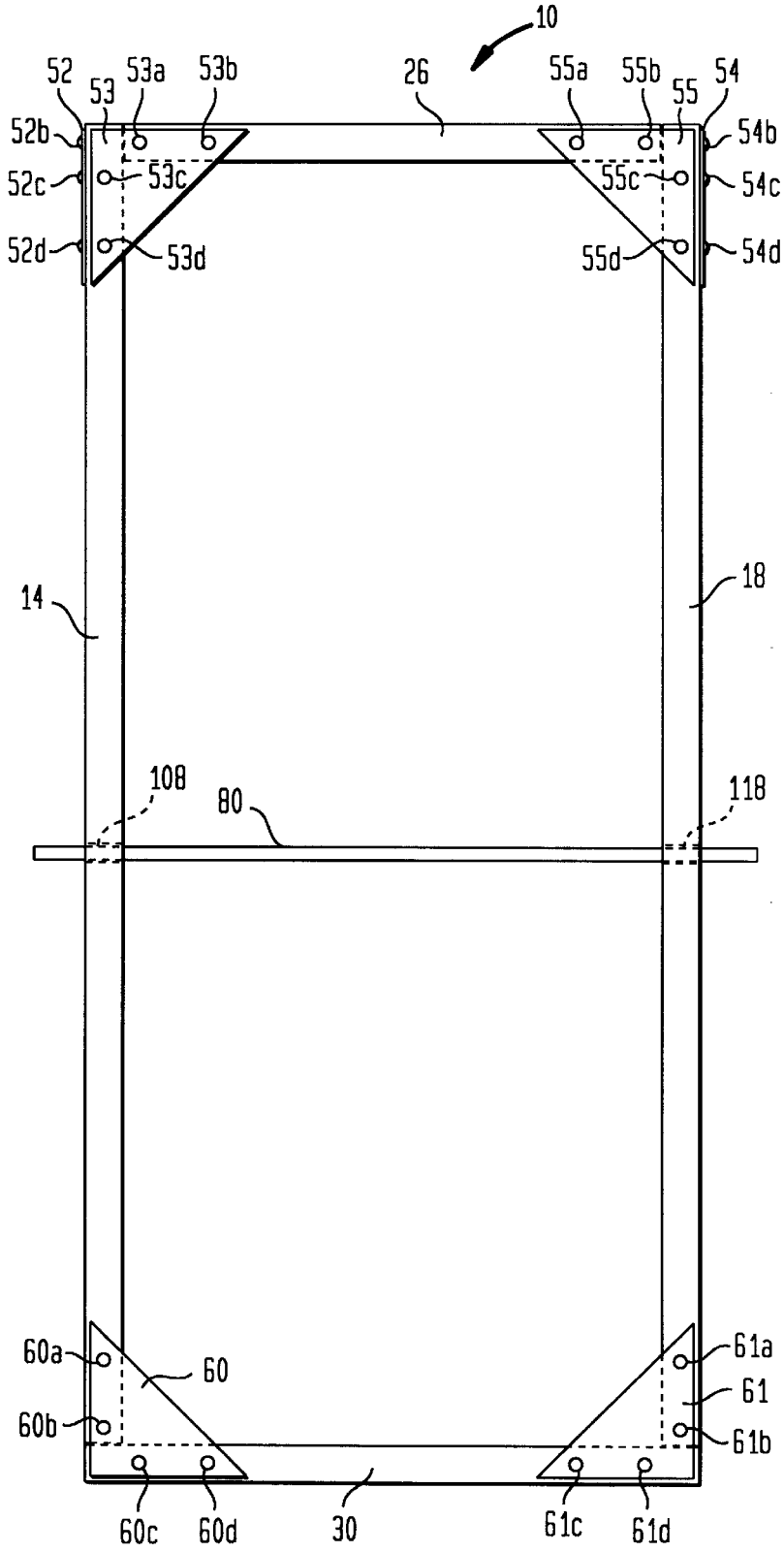
FIG. 5 shows a right view of the cage of FIG. 1.
Figure 6:
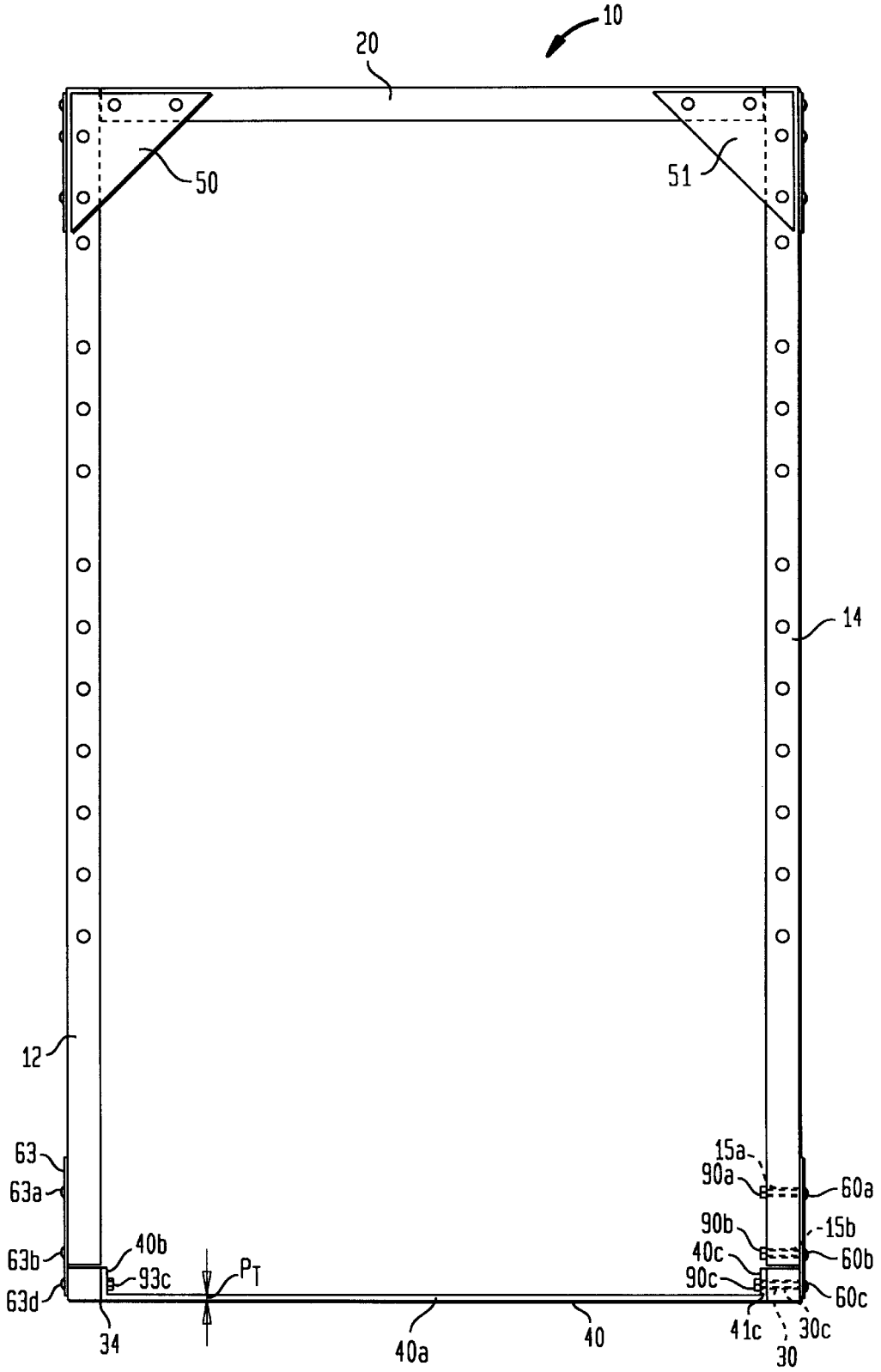
FIG. 6 shows a front view of the cage of FIG. 1.

A more detailed example of gusset plate connection is shown in FIGS. 5 and 6. FIG. 5 is a right side view of the cage 10. In FIG. 5 the gusset plate 53 is shown connecting the top member 26 with the side member 14. Bolts 53*a*, 53*b*, 53*c*, and 53*d* go through corresponding holes in the gusset plate 53 and then through corresponding holes in the side member 14 and top member 26. A nut, not shown, is threaded and tightened on each of the bolts 53*a*, 53*b*, 53*c*, and 53*d*, so that when tightened the gusset plate 53 is fixed to the side member 14 through bolts 53*c* and 53*d* and their corresponding nuts, and gusset plate 53 is fixed to the top member 26 through bolts 53*a* and 53*b* through bolts 53*a* and 53*b* and their corresponding nuts.

Similarly gusset plate 55 is fixed to side member 18 by bolts 55*c* and 55*d* and fixed to top member 26 by bolts 55*a* and 55*b*. Gusset plates 50, 51, 52, 54, 56, and 57, identified in FIG. 1, are fixed in the same manner to top member 20 and side member 12, to top member 22 and side member 12, to top member 20 and side member 14, to top member 24 and side member 18, to top member 22 and side member 16, and to top member 24 and side member 16, respectively.

The side member 14 is connected at its bottom end 14*b* to bottom members 30 and 40 by gusset plate 60. As shown in FIG. 5, the gusset plate 60 is connected to side member 14 by bolts 60*a* and 60*b* which pass through corresponding holes in the gusset plate 60 and in the side member 14. Corresponding threaded nuts are placed on the bolts 60*a* and 60*b* and tightened. The gusset plate 60 is connected to bottom member 30 by bolts 60*c* and 60*d* which pass through corresponding holes in the gusset plate 60, in the bottom member 30 and in the bottom member 40. As shown in FIG. 6, which is a front view of the cage 10, bottom member 40 has a substantially flat portion 40*a* and opposing perpendicular extensions 40*b* and 40*c*. The bottom member 40 is connected to the bottom member 30 by the bolt 60*c* which passes through a hole 30*c* in the bottom member 30 and then passes through a hole 41*c* in the extension portion 40*c* of the bottom member 40. A nut 90*c* preferably is threaded on the end of the bolt 60*c* and tightened to secure the bottom member 40 to the bottom member 30.

Similarly, the gusset plate 60 is connected to the side member 14 by bolts 60*a* and 60*b* which pass through the holes 15*a* and 15*b* of the side member 14 and have nuts 90*a* and 90*b* threaded and tightened thereon, respectively. Similarly, gusset plate 63 is connected to side member 12 by bolts 63*a* and 63*b* which pass through corresponding holes in the gusset plates and in the side member 12 and the gusset plate 63 is connected to bottom member 34 and extension 40*b* of bottom member 40 by bolts 63*d* and another bolt not shown (similar to bolt 61*c* of FIG. 5). Bolt 63*d* goes through corresponding holes in gusset plate 63, bottom member 34 and extension 40*b* of bottom member 40 and is threaded and tightened at its end by nut 93*c*.

Referring back to FIG. 5, gusset plate 61 is connected to side member 18 by bolts 61*a* and 61*b* and to bottom member 30 by bolts 61*c* and 61*d*. There is another gusset plate 62, shown in FIG. 1, similar to gusset plate 61, which would connect the side member 16 with the bottom member 34.

A bench 70 is shown in FIG. 1 which can be any conventional weight lifting bench. A weight lifting bar 11 is shown with weights 13 and 15. The weight lifting bar 11 rests on hooks 16*a* and 18*a*, which can be mounted at different locations on members 16 and 18 respectively. Two steel bars 80 and 82 are shown. Bar 80 will be thought of as being on the right side of the cage 10 while bar 82 will be thought of as being on the left side of the cage 10. As shown in FIG. 1, there are holes 101–111 in side member 14. There are corresponding holes in side members 12, 16, and 18. There are other holes in side members 12, 14, 16, and 18 for attaching the gusset plates which may not be shown. The bar 80 can be inserted through hole 108 and then through hole 118 of the side member 18. The bar 80 is preferably level when inserted through holes 108 and 118 and can be used in conjunction with bar 82 as a safety device when someone is using the bench 70 to do bench presses with a weight lifting bar 11 of FIG. 1.

Figure 2:
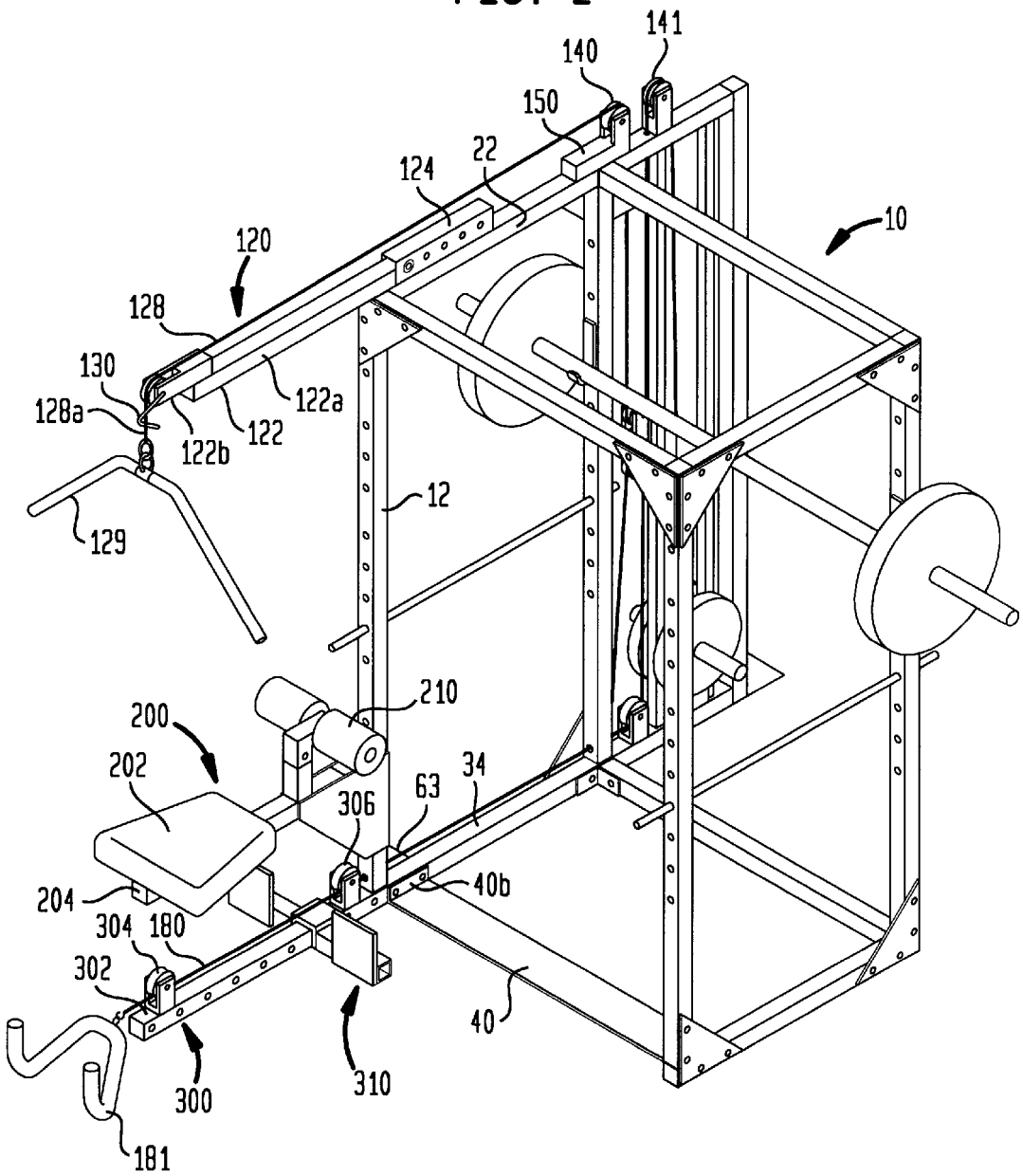
FIG. 2 shows a perspective view of the cage of FIG. 1 along with an upper pulley device, an adjustable seating device, and a lower pulley device, which includes a foot brace device.

FIG. 2 shows a perspective view of the cage 10 of FIG. 1 along with an upper pulley device 120, an adjustable seating device 200, and a lower pulley device 300.

Figure 10:
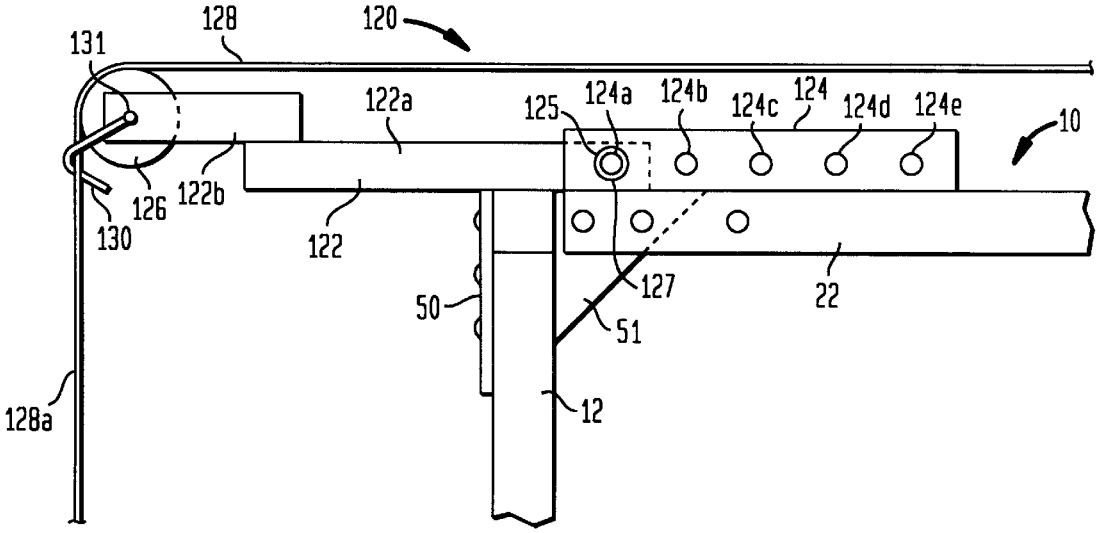
FIG. 10 shows an adjustable member with pulley for an upper pulley device for use with the embodiment of FIG. 2.

Referring in detail to FIG. 10, the upper pulley device 120 is comprised of an adjustable member 122 comprised of a first portion 122*a* and a second portion 122*b*. The upper pulley device 120 is also comprised of a fixed member 124 which is fixed to the top member 22 of the cage 10. The upper pulley device 120 also includes a pulley 126 which is rotatably mounted in a groove in the middle of portion 122*b* of the adjustable member 122. The portions 122*b* and 122*a* are elongated members which in this instance are substantially rectangular. The portion 122*b* lies on top of and substantially parallel to the portion 122*a*.

The adjustable member 122 can be slid in and out of the fixed member 124 in order to adjust the position of the adjustable member 122 with respect to the cage 10. This also adjusts the position of the pulley 126. The portion 122*a* has a hole 125 which can be aligned with any one of the holes 124*a* through 124*e* in the fixed member 124. A bolt such as bolt 127 can then be inserted through the hole 125 and a hole such as hole 124*a* in order to temporarily fix the adjustable member 122 to the cage 10.

The upper pulley device 120 also includes a bolt 131 about which the pulley 126 rotates. A cord 128 is also show and it runs from its first end 128*a* over the pulley 126 and across FIG. 10 over to the rest of the upper pulley device 120 which will be described with reference to FIG. 11. A hook 130 is also shown and it has a corresponding opposing hook not shown. The hook 130 is to stabilize a lat bar 129 shown in FIG. 2, which is connected to the first end 128*a* of the cord 128, when low rows are done with the lower pulley device 300.

Figure 11:
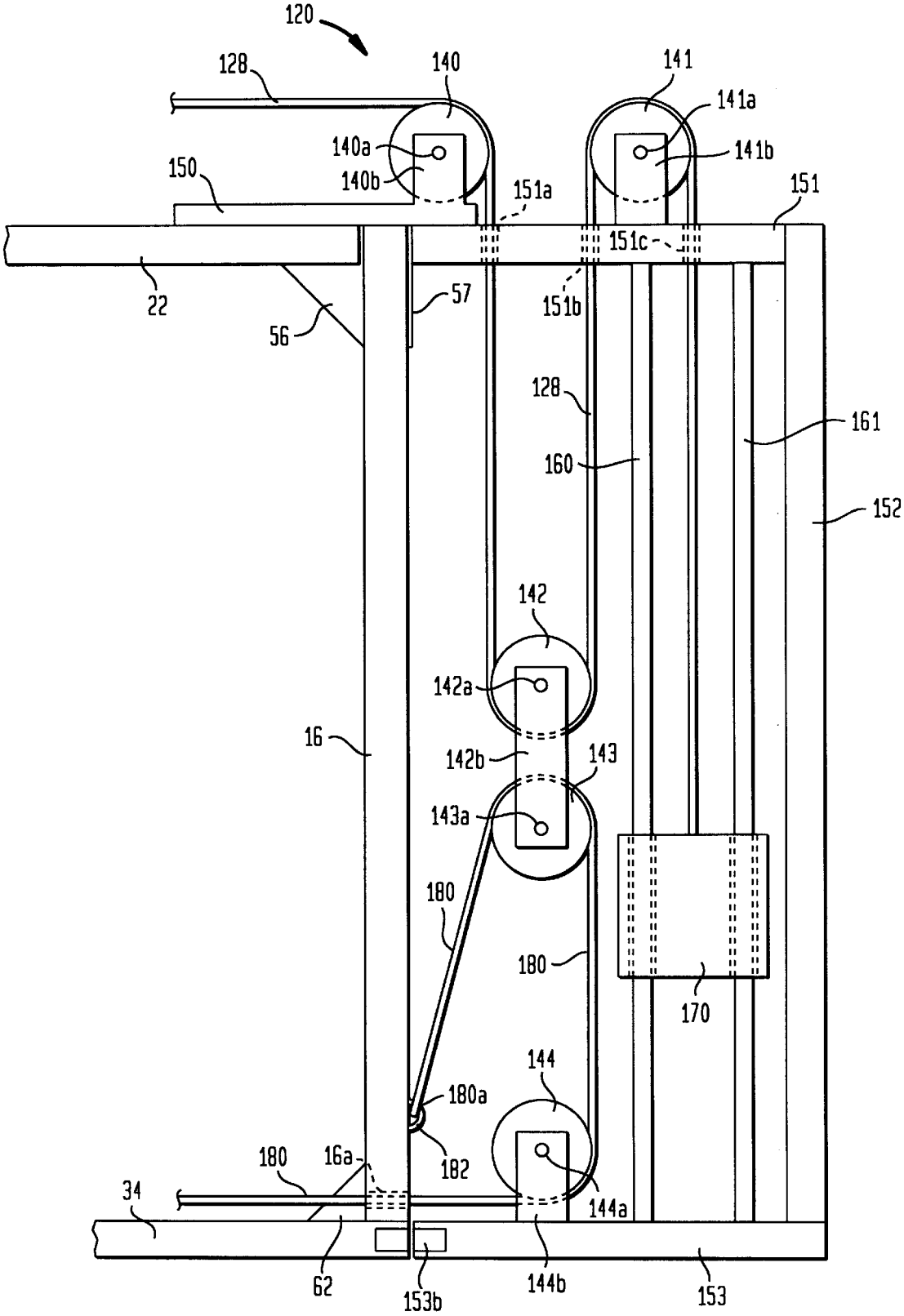
FIG. 11 shows parts of the upper and lower pulley devices for use with embodiment of FIG. 2.

Referring to FIG. 11, the continuation of the upper pulley device 120 is shown. Note that some of the components for the upper pulley device 120 are also components of the lower pulley device 300 since in this embodiment the two devices are interrelated. FIG. 11 shows the cord 128 passing over a pulley 140. The pulley 140 is rotatably mounted using the bolt 140*a* to the extension 140*b*. The extension 140*b* is fixed to the member 150 which is connected to the top member 22 of the cage 10 and to a member 151 of the upper pulley device 120. The member 151 includes holes 151*a*, 151*b*, and 151*c* which allow the cord 128 to pass through as will be described. The member 151 is fixed to a side member 152 which is fixed to a bottom member 153. The bottom member 153 is fixed to the bottom member 34 of the cage 10, such as by a rectangular gusset plate 153*b*. All of the lower pulley device 120 and upper pulley device 300 can be added to the cage 10 in a modular manner, i.e. as an "add on" feature to the cage 10.

The cord 128 after passing over the top of pulley 140 proceeds downwards through the hole 151*a* of top member 151 and then around and under a pulley 142. The pulley 142 is rotatably mounted to a plate 142*b* via a bolt 142*a*. Preferably there is a mirror plate behind plate 142*b*, so that pulley 142 rotates between the two plates. Another pulley 143 is also rotatably mounted to the plate 142*b* via a bolt 143*a*. The plate 142*b* and its mirror image, can be called floating plates, since they are not fixed to any member but rather move up or down depending upon whether the cord 128 of the upper pulley device 120 is used or whether a cord 180 of the lower pulley device 300 is used. Preferably there is enough space between the pulleys 142 and 143 so that the cords 128 and 180 do not rub against one another.

The cord 128 after going around pulley 142 goes upwards through hole 151*b* of the top member 151. The cord 128 then goes around and over pulley 141. Pulley 141 is rotatably mounted by bolt 141*a* to extension 141*b* of top member 151. The cord 128 comes down from pulley 141 through hole 151*c* of top member 151 and connects to weight device 170. Weight device 170 is guided and rides on rails 160 and 161. The rails 160 and 161 are fixed at their top ends to top member 151 and at their bottom ends to bottom member 153. The top member 151 is fixed to the bottom member 153 by the side member 152.

The cord 180 and some of the other components described can be thought of as either being part of the upper pulley device 120 or the lower pulley device 300. The cord 180 is fixed at its first end 180*a* via anchor 182 to the side member 16 of the cage 10. The cord 180 runs from its first end 180*a*, around and over the pulley 143 and down to the pulley 144. The pulley 144 is rotatably mounted via a bolt 144*a* to an extension 144*b* of the bottom member 153. The cord 180 goes around and under the pulley 144, through the hole 16*a* of the side member 16 and out towards the rest of the lower pulley device 300 shown in FIG. 7.

Figure 7:
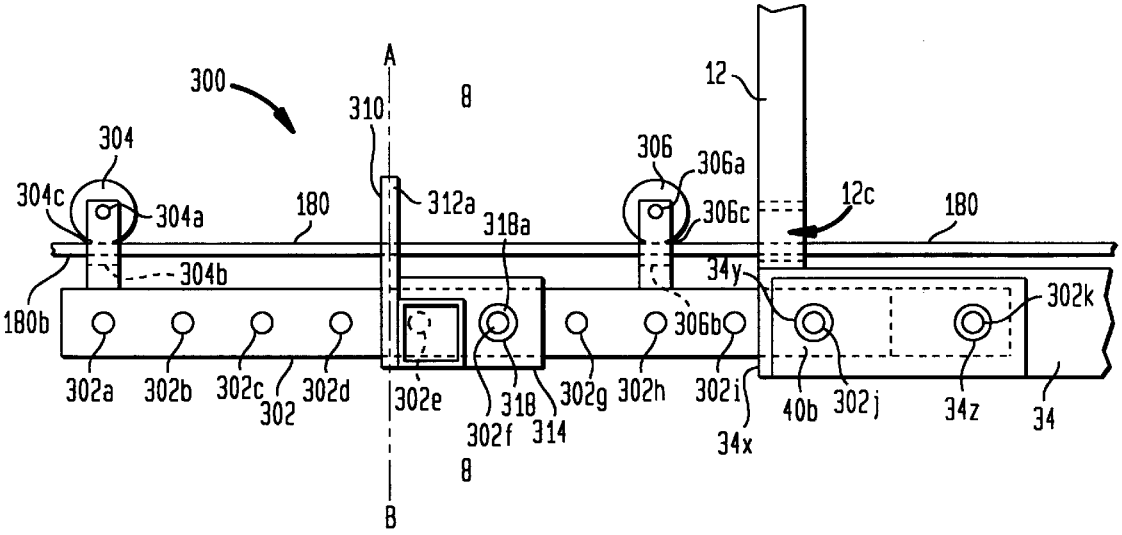
FIG. 7 shows the lower pulley device of FIG. 2.

FIG. 7 shows lower pulley device 300. The lower pulley device 300 includes adjustable member 302 having holes such as hole 302*a*–302*k*. The lower pulley device 300 also includes pulleys 304 and 306 rotatably mounted via bolts 304*a* and 306*a* to extensions 304*b* and 306*b*, respectively, of the adjustable member 302. The cord 180 passes through a hole 12*c* in the side member 12 of the cage 10. The cord 180 then passes through a space 306*c* and a space 304*c* which allow it to engage the underside of pulleys 306 and 304, respectively. The cord comes out at its other end 180*b* which can be connected to rowing bar 181 shown in FIG. 2. The adjustable member 302 can be slid in and out of the bottom member 34 of the cage 10. The bottom member 34 is preferably a hollow tube having an opening 34*x* for the adjustable member 302 to be inserted into. The bottom member 34 preferably also has holes 34*y* and 34*z* through which bolts like bolt 63*d* of FIG. 6, can be placed to both temporarily fix the adjustable member 302 and to fix the extension 40*b* of the bottom member 40 of the cage 10. Thus a bolt, such as bolt 63*d*, shown in FIG. 6 would preferably go through a hole in gusset plate 63, through a hole in bottom member 34, such as hole 34*y* then through a hole in adjustable member 302 such as hole 302*j* then again through hole 34*y* of the bottom member 34, then through a corresponding hole in extension 40*b* of the bottom member 40. A second bolt similarly would be preferably provided through hole 34*z*.

Figure 8:
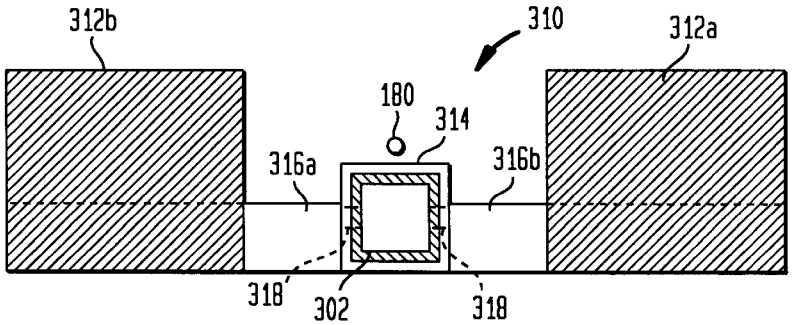
FIG. 8 shows an adjustable foot brace device for use in the embodiment of FIG. 7.

Also shown in FIG. 7 is a foot brace device 310. The foot brace device 310 is comprised of right foot rest portion 312*a*, left foot rest portion 312*b*, center tubular portion 314, and connective portions 316*a* and 316*b*. The connective portions 316*a* and 316*b* connect and space the left and right foot rest portions 312*b* and 312*a* from the center tubular portion 314. The center tubular portion 314 surrounds the adjustable member 302 as shown in FIG. 8. FIG. 8 is a cross section along line AB of the FIG. 7. The center tubular portion 314 and thus the entire foot brace device 310 can be slid across the length of the adjustable member 302. A hole 318 through the center tubular portion 314 allows the foot brace device 310 to be fixed somewhere along the length of the adjustable member 302. A bolt 318*a* can be inserted into the hole 318 and into a corresponding hole 302*f* in the adjustable member 302. FIG. 8 also shows where the cord 180 would pass over the foot brace device 310.

Figure 9:
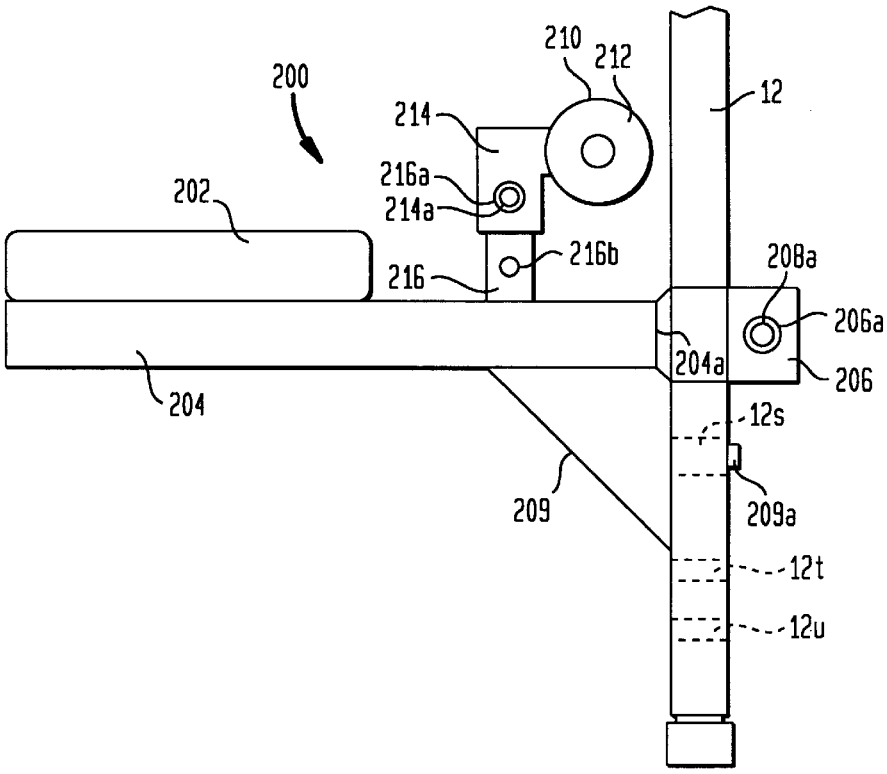
FIG. 9 shows an adjustable seating device for use in the embodiment of FIG. 2.

FIG. 9 shows an adjustable seating device 200 in accordance with the present invention. The adjustable seating device 200 includes a seat 202, an adjustable member 204, a flange 206, and a support member 209. The seat 202, flange 206 and support member 209 are all fixed to the adjustable member 204. The adjustable member 204 is adjustable along with the other components in the sense that it can be moved vertically up and down and then temporarily fixed to various vertical positions along the side member 12 of the cage 10. In addition a knee restraint device 210 comprised of padded roller 212 and a tube 214 is shown. An extension 216 is attached to the adjustable member 204 and allows the knee restraint device 210 to be adjusted up or down.

Figure 19:
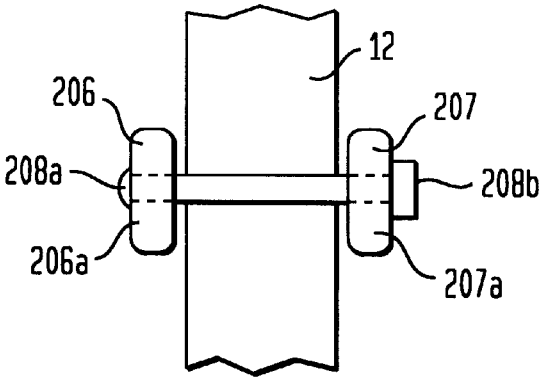
FIG. 19 shows a front view of the flange 206 of the adjustable seating device of FIG. 9 and its attachment to a side member 12.

Referring to FIGS. 9 and 19, the seating device 200 includes flanges 206 and a corresponding opposing flange 207, each of which has a hole 206*a* and 207*a*, respectively. A bolt 208*a* is inserted through the hole 206*a* and the hole 207*a* and then a nut 208*b* is threaded and tightened at the other end to connect flange 206 to flange 207. The bolt 208*a* preferably does not go through the side member 12, rather the side member 12 of the cage 10 lies in a gap between the front 204*a* of adjustable member 204 and the bolt 208*a*. The seating device 200 is further connected to the side member 12 by connecting support member 209 to side member 12 through hole 12*s* via bolt 209*a*, shown in FIG. 9. The purpose of the flanges 206 and 207 is to keep the adjustable member 204 from moving horizontally, when one needs to adjust the vertical height by temporarily removing the bolt 209*a* and moving the seating device 200 up or down the side member 12 of the cage 10. Holes 12*t* and 12*u* are other holes that can be used to fix the seating device 200 instead of hole 12*s*.

A bolt can be used to secure the knee restraint device 210 to the extension 216 of the adjustable member 204. The bolt can be placed through the hole 214*a* and then through the hole 216*a* and secured at the other end. The knee restraint device 210 can be adjusted and the bolt placed through hole 214*a* and then hole 216*b* of the extension 216.

Figure 3:
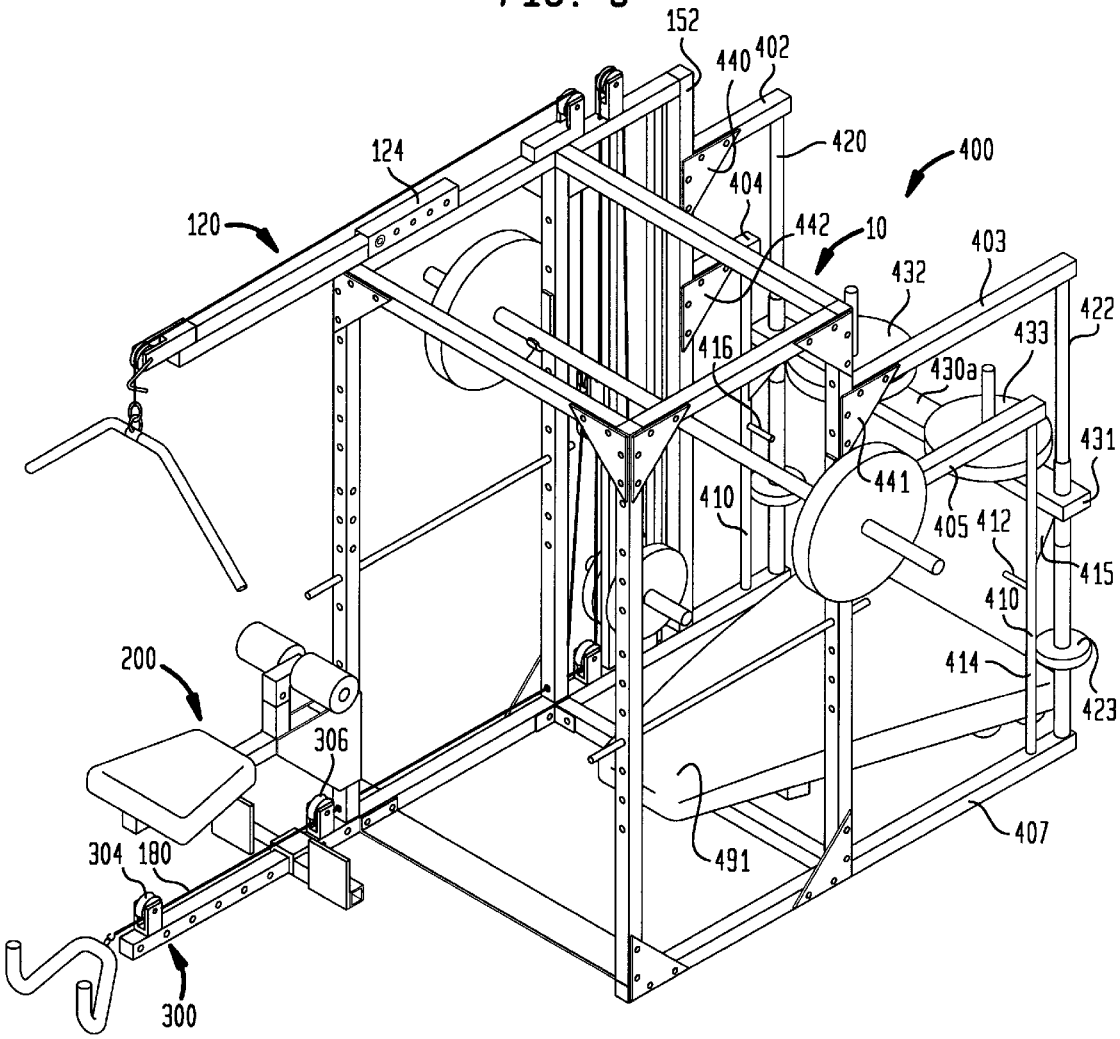
FIG. 3 shows a perspective view of the apparatus of FIG. 2 along with a vertical leg press device.
Figure 12:
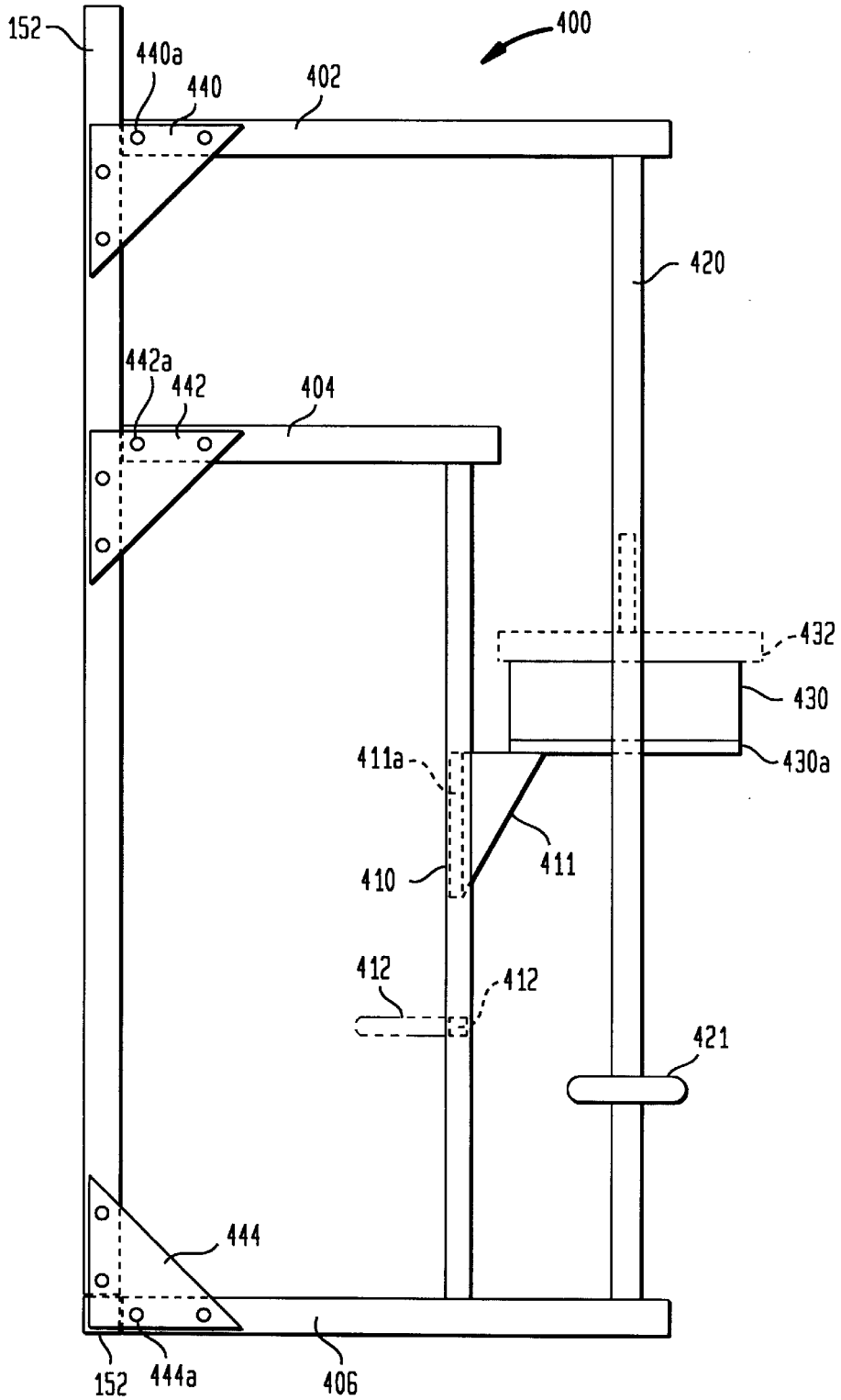
FIG. 12 shows the left side view of the leg press of FIG. 3.

FIG. 12 shows a detailed left side view of the leg press device 400 of FIG. 3. The leg press device 400 can be added to the cage 10 in a modular manner. The leg press device 400 includes top member 402, middle member 404, bottom member 406, side rail 420, and middle rail 410. The top member 402 is connected to the side member 152 of the upper pulley device 120 by a gusset plate 440 with bolts 440*a* in a manner previously described for the cage 10 with respect to FIG. 1. The top member 402 is also fixed to the top of rail 420. The bottom of rail 420 is fixed to the bottom member 406. The bottom member 406 is connected to the side member 152 of the upper pulley device 120 by gusset plate 444 through bolts 444*a* in a manner previously described. The bottom member 406 is also rotatably connected to the bottom of the middle rail 410. The top of the middle rail 410 is rotatably mounted to the middle member 404. The middle member 404 is also fixed to the middle of side member 152 by gusset plate 442 via bolts 442*a* in a manner previously described. A left weight carriage 430 moves up and down along the rail 420. A weight 432 can be provided on the left weight carriage 430. A stop 421 is provided on the rail 420 so that the left weight carriage 430 is prevented from going down further than the stop 421. The middle rail 410 can be rotated and has a triangular portion 411 and a handle portion 412. When the handle portion 412 points into the page of FIG. 12, the triangular portion 411 holds up the weight carriage 430 and prevents it from going any further downwards. When the handle portion 412 is parallel to the page as shown by the dotted lines, the triangular portion 411 does not prevent the left weight carriage 430 from moving downwards and thus a user can then put his feet under the left weight carriage 430 and push it upwards and then allow it to retract back downwards. The triangular portion 411 is then in a position 411*a* in order for the weight carriage 430 to drop down. The left weight carriage 430 includes a safety pad 430*a* for allowing the left weight carriage 430 to land on the triangular portion 411 without clanking, scratching or damaging these structures.

Figure 13:
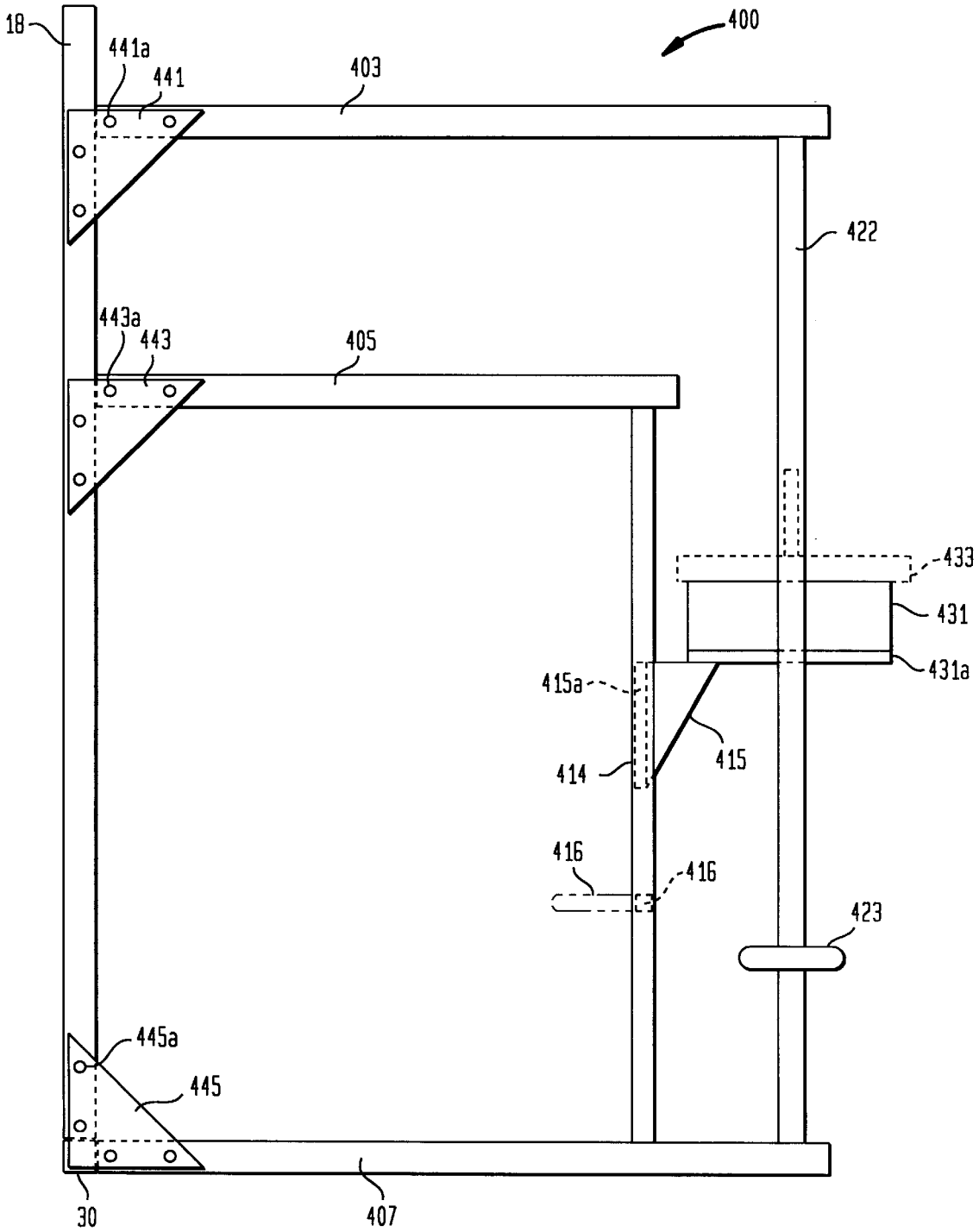
FIG. 13 shows the right side view of the leg press of FIG. 3.

FIG. 13 shows the right side view of the leg press device 400 of FIG. 3. This view is essentially a mirror image of FIG. 12 except that a top member 403, middle member 405, and bottom member 407, shown in FIG. 13 must be longer than the corresponding top member 402, middle member 404, and bottom member 406 shown in FIG. 12. This is because there is no upper or lower pulley device on the right side and thus the leg press device 400 is connected directly to the side member 18 of the cage 10 on the right side of the leg press device 400. Otherwise the following components of FIG. 13: gusset plates 441, 443, and 445, middle rail 414, handle 416, triangular portion 415, rail 422, right weight carriage 431 and landing pad 431*a* , weight 433, and stop 423 correspond to the following components of FIG. 12: gusset plates 440, 442 and 444, middle rail 410, handle 412, triangular portion 411, rail 420, left weight carriage 430 and landing pad 430*a*, weight 432, and stop 421.

Figure 4:
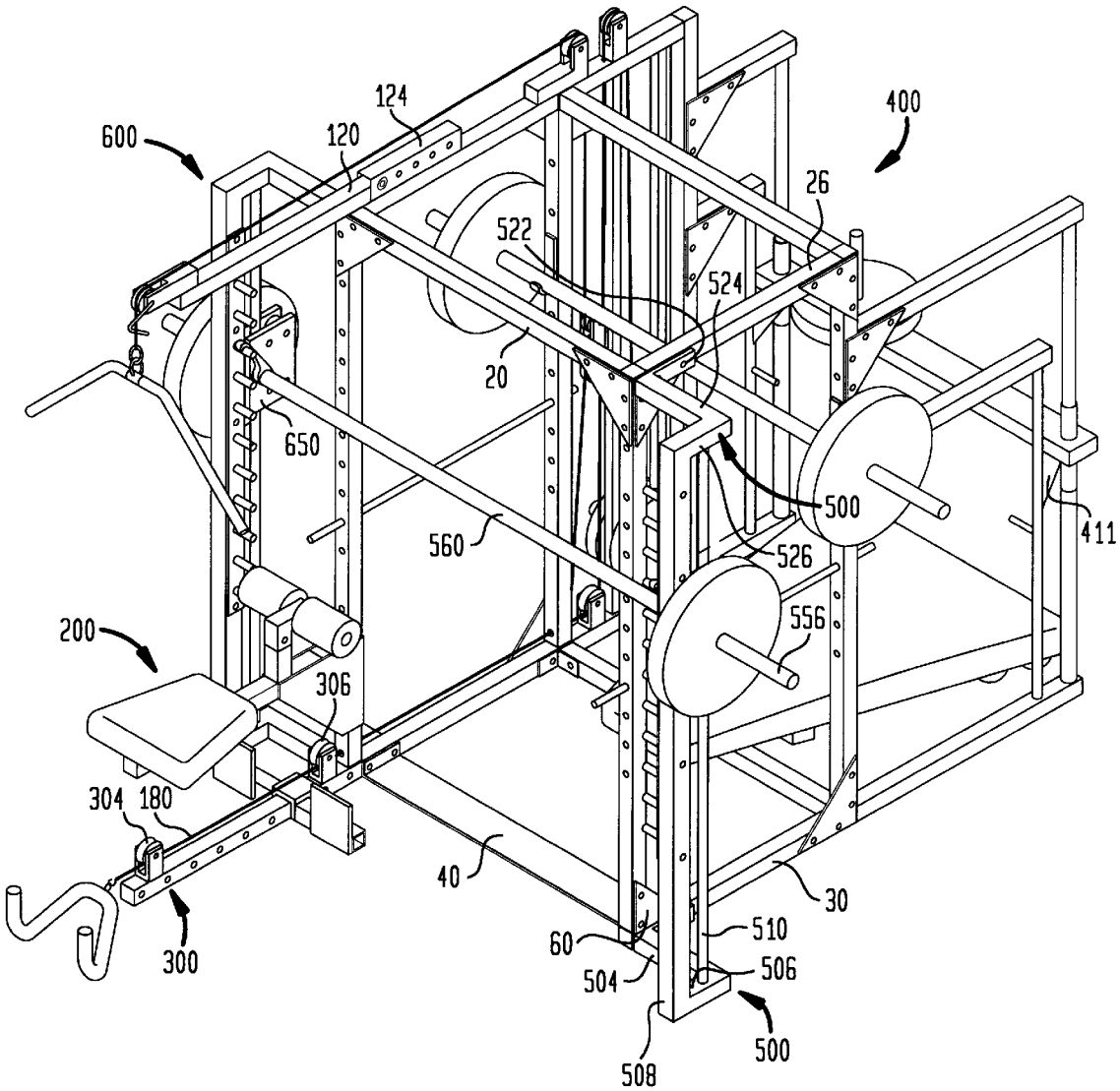
FIG. 4 shows a perspective view of the apparatus of FIG. 3 along with a weight lifting device of a type typically called a "Smith" machine.
Figure 14:
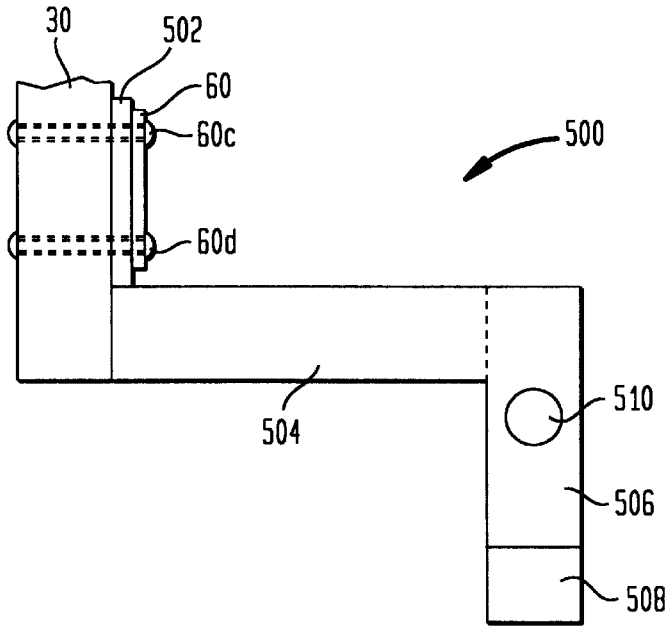
FIG. 14 shows the right footprint of the weight lifting device of FIG. 4.
Figure 15:
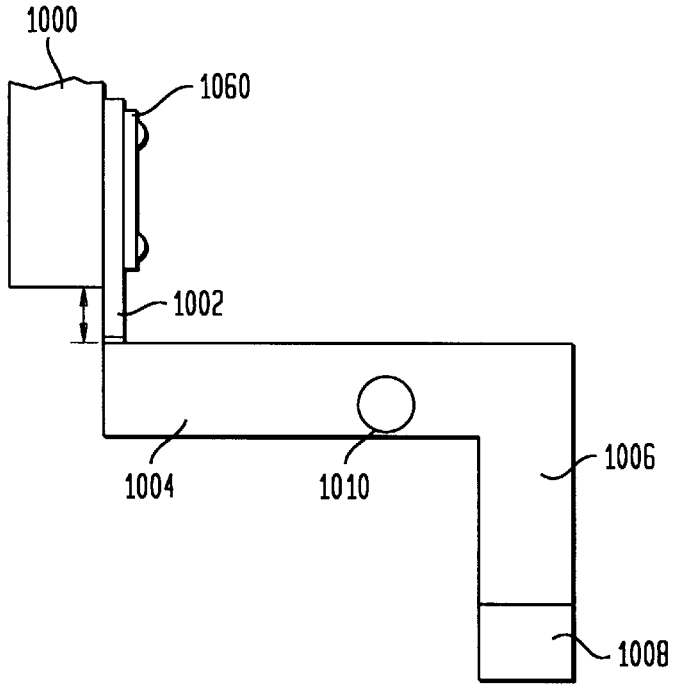
FIG. 15 shows a prior art footprint of a weight lifting device of a Smith Machine type.

FIG. 14 shows the footprint of the right side of a weight lifting device 500 of FIG. 4. The weight lifting device 500 is preferably of the type known as a "Smith machine". The weight lifting device 500 includes a flat bottom bar 502, a bottom member 504, a bottom member 506, and a side member 508, and these members are preferably seemlessly welded together. The bottom member 504 and bottom member 506 are preferably at right angles with respect to each other. The flat bottom bar 502 is preferably at a right angle with respect to the bottom member 504. The flat bottom bar 502 is preferably connected to the bottom member 30 of the cage 10 by gusset plate 60 by using bolts 60*c* and 60*d* which can be inserted through corresponding holes in the gusset plate 60, flat bottom bar 502 and bottom member 30, as shown in FIG. 14.

The weight lifting device 500 preferably includes a mirror image top structure. I.e. as can be seen partially in FIGS. 4 and 16, and 17, the device 500 includes a flat top bar 522, a top member 524, and a top member 526 corresponding to the flat bottom bar 502, and bottom members 504, and 506 respectively. The flat top bar 522 is connected to the top member 26 of the cage 10 as shown in FIGS. 4 and 17.

Figure 17:
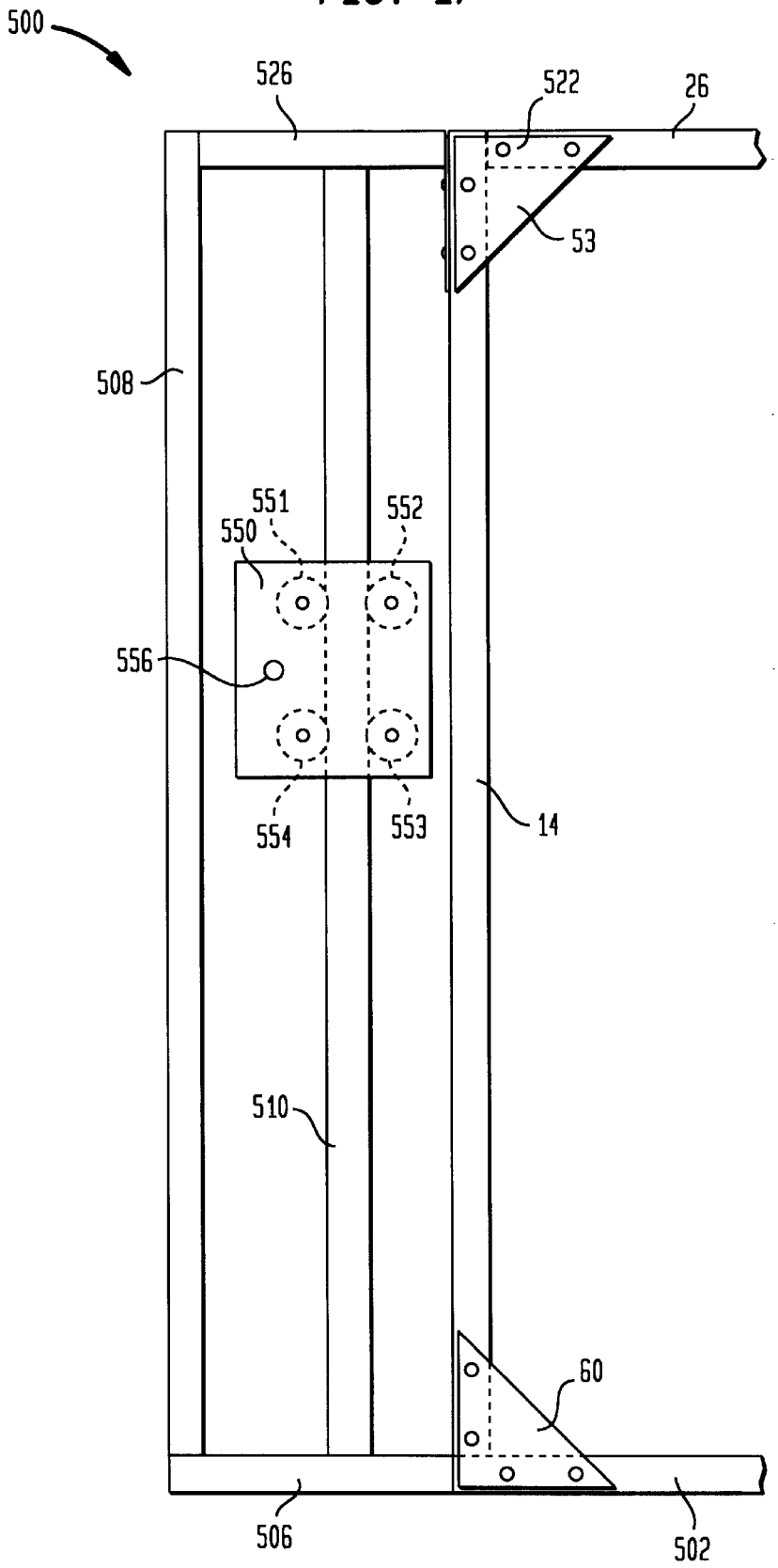
FIG. 17 shows an inner right side view of the weight lifting device in FIG. 4.
Figure 18:
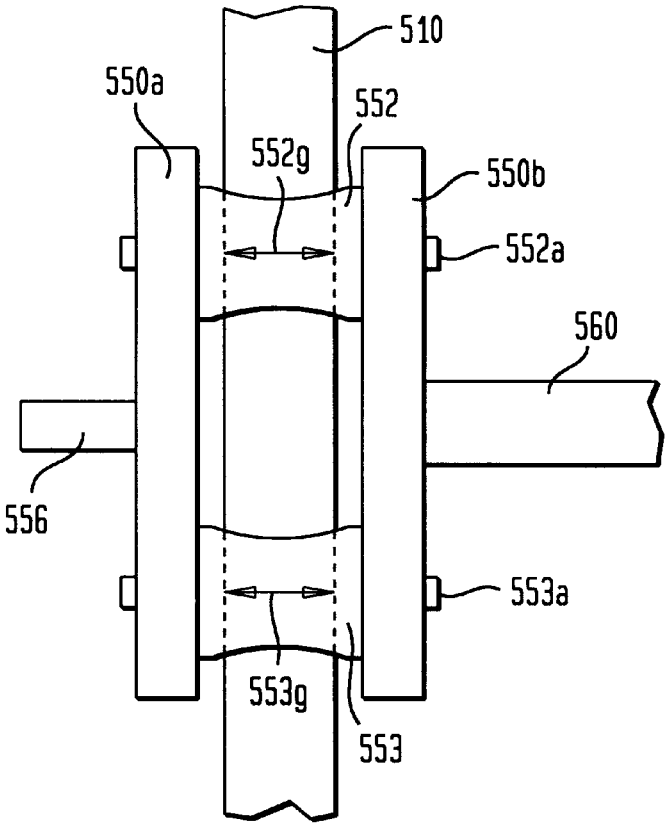
FIG. 18 shows a view from the back of the right side of the weight lifting device in FIG. 4.

The weight lifting device 500 is also comprised of a right rail 510 which extends from near the middle of the bottom member 506 to near the middle of the underside of the top member 526 which can be seen in FIG. 17. FIG. 17 a right side view of the device 500. FIG. 17 also shows a right weight carriage 550 having rollers 551, 552, 553, and 554. The carriage 550 is comprised of two plates 550*a* and 550*b* as shown in FIG. 18, which is a rear view of the right weight carriage 550. The right weight carriage 550 also has a protruding bar 556, and is connected to a large bar 560 at its right. The protruding bar 556 is preferably smaller in diameter than the large bar 560. The large bar 560 is connected to a mirror image left weight carriage 650 whose location is shown in FIG. 4. In general the device 500 is comprised of the right side which has been described and a mirror image left side 600 shown generally in FIG. 4.

The rollers 552 and 553 have gaps 552*g* and 553*g* for engaging with the rail 510, as shown in FIG. 18. The rollers 552 and 553 are preferably rotatably mounted using bolts 552*a* and 553*a*.

Figure 16:
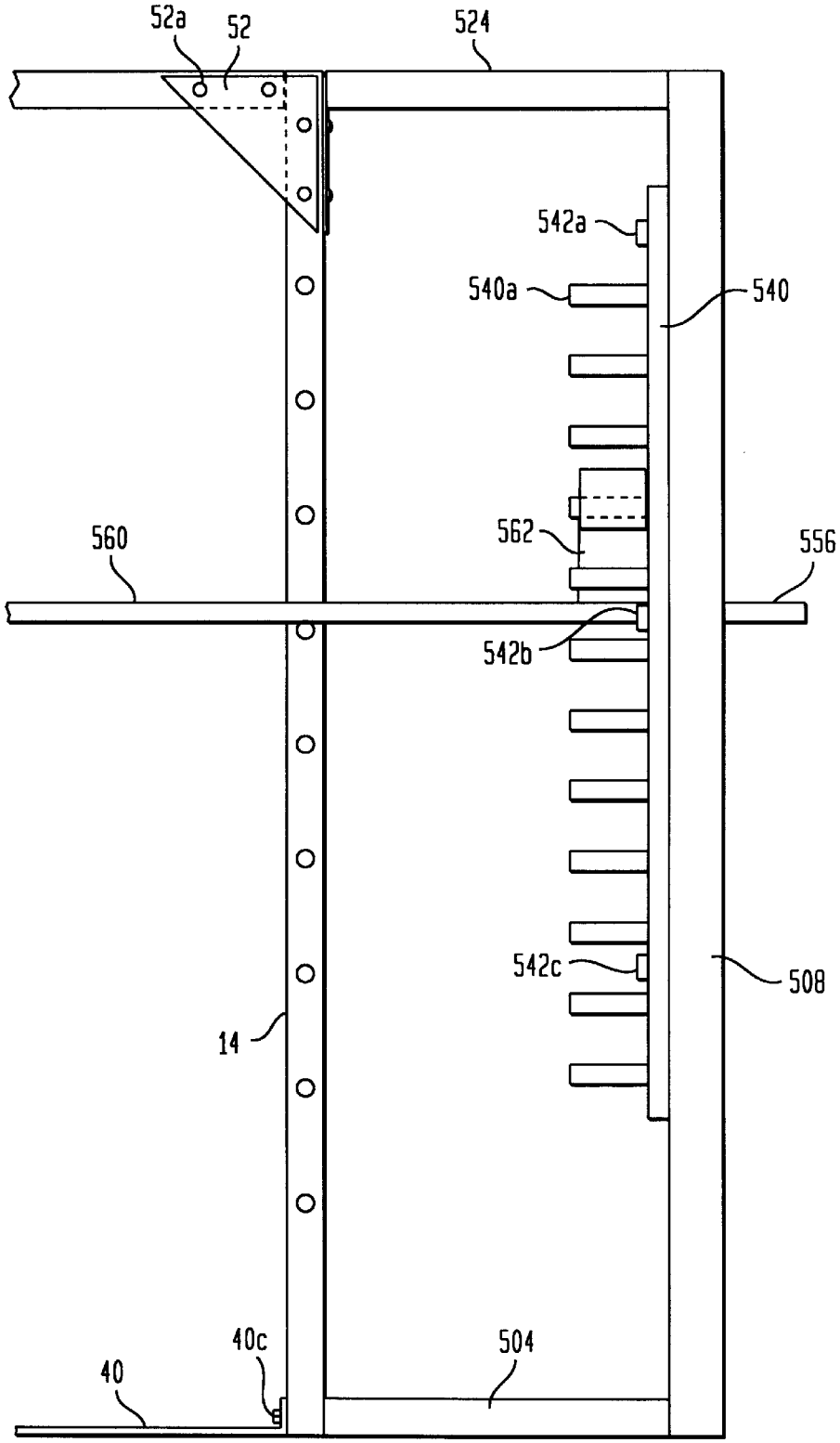
FIG. 16 shows a right side front view of the weight lifting device in FIG. 4.

FIG. 16 shows a plate 540 which is connected to side member 508 of the right side of the weight lifting device 500. The plate 540 includes protrusions such as protrusion 540*a*. These protrusions are for resting a latch 562 in order to rest the bar 560 to prevent it from falling down. The latch 562 is connected to the bar 560. The plate 540 is connected to the side member 508 by bolts 542*a–c*.

The cage 10, the upper pulley device 120, the seating device 200, the lower pulley device 300, the leg press device 400, and the weight lifting device 500 can be supplied in a modular manner. Various components can be eliminated or not supplied at all if desired. For example, one may employ only the cage 10 without any further structures. Or the cage 10 can be used with the upper pulley device 120 without any further structures. A user can also add on the other components as needed.

Figure 20:
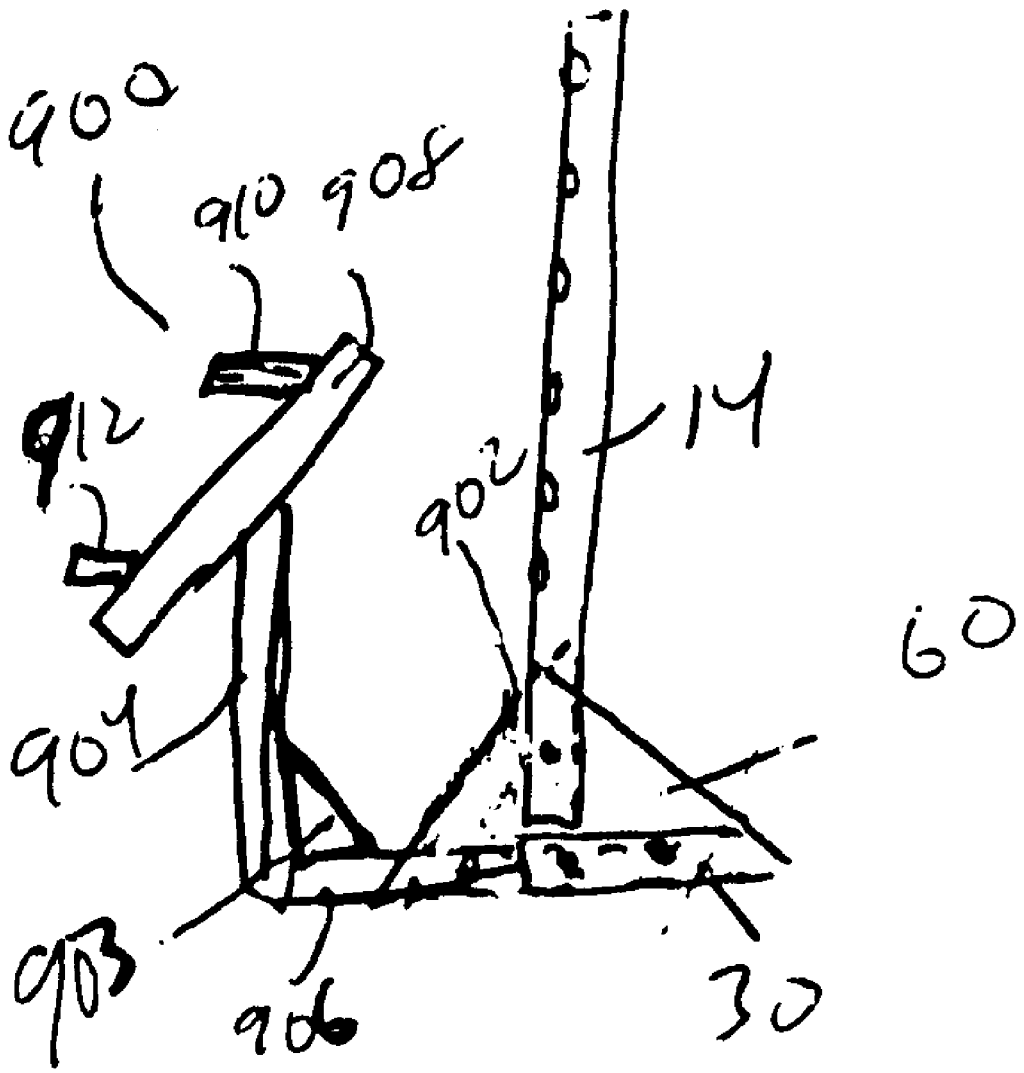
FIG. 20 shows a dipping bar device and its attachment to side member 14.

FIG. 20 shows an additional dipping bar device 900 which can be modularly inserted into the bottom member 30. The dipping bar device includes side member 904 and bottom member 906. The side member 904 is connected to the bottom member 906 by a gusset plate 903 which can be connected as previously described with respect to cage 10. The bottom member can then be slid into the hollow bottom member 30 and connected as described with reference to the lower pulley device 300. An additional gusset plate 902 can be used to provide further support. The dipping bar device 900 is further comprised of handles 910 and 912 and support structure 908.

The cage 10, the upper pulley device 120, the seating device 200, the lower pulley device 300, the leg press device 400, the weight lifting device 500, and dipping bar device 900 after assembly can be operated as follows. Referring to FIG. 1, a user can lie on bench 70 with his head under the bar 11 and pick up the bar 11 with weights 13 and 15 and do bench presses. The bar 11 can be rested back on hooks 16*a* and 18*a* when the user is done lifting.

Referring to FIG. 2, a user can sit on the seat 202, grab the two ends of the lat bar 129 and do lat pull downs. Again referring to FIG. 2, a user can sit on the ground, grab the two ends of lower lat pull device 181 and do rowing exercises. When doing rowing exercises the user would rest his feet on the foot brace device 310. The foot brace device 310 is used to prevent the user from sliding forward when doing rowing exercises. The upper pulley device 120 can be adjusted by sliding the adjustable member 122 in or out of fixed member 124. The seating device 200 and the foot brace device 310 also can be adjusted. The upper pulley device 120, seating device 200, or the brace device 310 can all be removed from the cage 10.

Referring to FIG. 3, the leg press device 400 is operated by a user lying down on a pad 491 so that his feet are under carriage bar 430*b* which connects carriage device 430 with carriage device 431 shown in FIG. 3. The user puts the bottoms of his feet under the carriage bar 430*b* so that his feet rest on surface 430*a*. The user then pulls the handles 412 and 416 so that the triangular portions 411 and 415 no longer hold up the weight carriage device 430, 431, and bar 430*b*. At that time the handles 412 and 416 will be in the dashed positions shown in FIGS. 12 and 13. The weight carriage device, 430, 431, and bar 430*b* then rest on the user's feet and he can push 430, 431, and 430*b* up and down by pushing his legs outward and then retracting his legs.

Referring to FIGS. 4 and 16, the weight lifting device 500 is operated by a user picking up bar 560 which releases the latch 562 from one of the protrusions 540*a*. The user can then push the bar 560 upwards and retract it downwards until he is done exercising. When he is done, the user can rest the latch 562 on one of the protrusions 540*a* and thus allow the bar 560 to remain stationary.

The dipping bar device 900 of FIG. 20 can be operated by a user grabbing both handles 910 and 912 and performing dipping exercises which is a term known in the art.

The gusset plates such as gusset plate 52 can be square or rectangular or triangular as shown, or any other shape desired. A cage such as cage 10 can be constructed with a members inserted in a tube in a tube manner as opposed to using gusset plates. For example, member 26 in FIG. 5 could be inserted into member 14, through a hole at the top of member 14, and then bolted together.

I claim:

1. An apparatus comprised of:

cage having a right member and a left member;

a weight lifting device comprised of:

a right side member and a left side member;

a right rail and a left rail;

a first right bottom member and a second right bottom member, said members substantially perpendicular to one another;

a first left bottom member and a second left bottom member, said members substantially perpendicular to one another;

a first right top member and a second left top member, said members substantially perpendicular to one another;

a first right top member and a second left top member, said members substantially perpendicular to one another;

a right bottom flat member and a left bottom flat member, the right bottom flat member substantially perpendicular to the first right bottom member, and the left bottom flat member substantially perpendicular to the first left bottom member;

wherein the right bottom flat member is connected to the right member of the cage so that the right bottom flat member is parallel to and adjacent the right member of the cage, and left bottom flat member is connected to the left member of the cage so that the left bottom flat member is parallel to and adjacent the left member of the cage;

and wherein the right rail has a first end connected substantially in the middle of the second right bottom member and a second end connected substantially in the middle of the second right top member;

and wherein the left rail has a first end connected substantially in the middle of the second left bottom member and a second end connected substantially in the middle of the second left top member.

* * * * *

UNITED STATES PATENT AND TRADEMARK OFFICE

CERTIFICATE OF CORRECTION

PATENT NO. : 6,299,568 B1
DATED : October 9, 2001
INVENTOR(S) : Gerard L. Prok

It is certified that error appears in the above-identified patent and that said Letters Patent is hereby corrected as shown below:

Column 10,
Line 2, should read:
-- . An apparatus comprised of:
cage having a right member and a left member;
a weight lifting device comprised of:
a right side member and a left side member;
a right rail and a left rail;
a first right bottom member and a second right bottom member, said members substantially perpendicular to one another;
a first left bottom member and a second left bottom member, said members substantially perpendicular to one another;
a first right top member and a second left top member, said members substantially perpendicular to one another;
a first top right top member and a second left top member, said members substantially perpendicular to one another;
a right bottom flat member and a left bottom flat member, the right bottom flat member substantially perpendicular to the first right bottom member, and the left bottom flat member substantially perpendicular to the first left bottom member;
wherein the right bottom flat member is connected to the right member of the cage so that the right bottom flat member is parallel to and adjacent the right member of the cage, and left bottom flat member is connected to the left member of the cage so that the left bottom flat member is parallel to and adjacent the left member of the cage;
and wherein the right rail has a first end connected substantially in the middle of the second right bottom member and a second end connected substantially in the middle of the second right top member;
and wherein the left rail has a first end connected substantially in the middle of the second left bottom member and a second end connected substantially in the middle of the second left top member; and

UNITED STATES PATENT AND TRADEMARK OFFICE

CERTIFICATE OF CORRECTION

PATENT NO. : 6,299,568 B1
DATED : October 9, 2001
INVENTOR(S) : Gerard L. Prok

It is certified that error appears in the above-identified patent and that said Letters Patent is hereby corrected as shown below:

Column 10, cont'd a right carriage comprised of an inner plate connected to a large bar, an outer plate having an outer protrusion, and first and second rollers, said first and second rollers opposing one another, the right rail lying between the first and second rollers of the right carriage, the right carriage able to move up and down the right rail and as it moves the two opposing rollers rotate and;

a left carriage comprised of an inner plate connected to the large bar, an outer plate having an outer protrusion, and first and second rollers, said first and second rollers opposing one another, the left rail lying between the first and second rollers of the left carriage, the left carriage able to move up and down the left rail and as it moves the two opposing rollers rotate. --

Signed and Sealed this

Twenty-third Day of July, 2002

*Attest:*

*Attesting Officer*

JAMES E. ROGAN
*Director of the United States Patent and Trademark Office*